US009988860B2

(12) United States Patent
Salem et al.

(10) Patent No.: US 9,988,860 B2
(45) Date of Patent: Jun. 5, 2018

(54) METHOD AND APPARATUS FOR ELEVATING THE TAPERED STRESS JOINT OR FLEX JOINT OF AN SCR ABOVE THE WATER

(71) Applicant: Single Buoy Moorings, Inc., Marly OT (CH)

(72) Inventors: Amir Salem, Houston, TX (US); Thomas Prichard, Houston, TX (US)

(73) Assignee: Single Buoy Moorings, Inc., Marly (CH)

( * ) Notice: Subject to any disclaimer, the term of this patent is extended or adjusted under 35 U.S.C. 154(b) by 51 days.

(21) Appl. No.: 14/958,140

(22) Filed: Dec. 3, 2015

(65) Prior Publication Data

US 2017/0159377 A1 Jun. 8, 2017

(51) Int. Cl.
*E21B 17/01* (2006.01)
*E21B 19/00* (2006.01)

(52) U.S. Cl.
CPC ..... *E21B 19/004* (2013.01); *E21B 17/01* (2013.01)

(58) Field of Classification Search
CPC ..... E21B 17/01; E21B 17/015; E21B 17/017; E21B 17/085; E21B 19/004
See application file for complete search history.

(56) References Cited

U.S. PATENT DOCUMENTS 4,384,724 A 5/1983 Derman
5,269,629 A * 12/1993 Langner ..... E21B 19/004 166/367
6,494,273 B1 * 12/2002 Martin ..... E21B 19/06 166/77.1
6,631,745 B2 * 10/2003 Fontenot ..... B63B 21/50 114/230.13
6,659,690 B1 12/2003 Abadi
6,739,804 B1 * 5/2004 Haun ..... E21B 17/015 166/355
6,835,025 B1 * 12/2004 Beard ..... E21B 19/004 405/184.4

(Continued)

FOREIGN PATENT DOCUMENTS

GB 2336382 A * 10/1999 ..... E21B 19/004

OTHER PUBLICATIONS

International Search Report and the Written Opinion of the International Searching Authority, dated Mar. 17, 2017, 14 pages.

*Primary Examiner* — Matthew R Buck
(74) *Attorney, Agent, or Firm* — Blank Rome LLP

(57) ABSTRACT

A removable riser hang-off connector is equipped with a flexible element that, in one embodiment, comprises rubber-encapsulated steel plates. The connector is designed for attachment to a hang-off collar provided on a steel catenary riser below the tapered stress joint or flex joint. Connection of the removable riser hang-off connector may be made by an ROV. With the removable riser hang-off connector attached, the tapered stress joint and/or flex joint may be raised out of the water (for inspection, maintenance, repair or replacement) by lifting the upper end of the SCR out of its porch receptacle with a chain jack (or other lifting device) and inserting the removable riser hang-off connector into the porch receptacle. This temporarily supports the SCR in an elevated state with the tapered stress joint and/or flex joint above the surface of the water.

29 Claims, 16 Drawing Sheets

(56) References Cited

U.S. PATENT DOCUMENTS

| | | | | |
|---|---|---|---|---|
| 7,467,914 | B2 * | 12/2008 | Finn | E21B 17/015 405/224.2 |
| 7,472,755 | B2 * | 1/2009 | Riggs | E21B 17/015 166/359 |
| 7,914,234 | B2 * | 3/2011 | Large | E21B 19/004 405/223.1 |
| 8,550,171 | B2 | 10/2013 | Wajnikonis et al. | |
| 8,689,882 | B2 | 4/2014 | Wajnikonis et al. | |
| 9,206,655 | B2 * | 12/2015 | Sipos | E21B 19/06 |
| 9,587,446 | B2 * | 3/2017 | Teichmiller | E21B 19/002 |
| 2002/0060077 | A1 | 5/2002 | Blaney | |
| 2002/0162665 | A1 | 11/2002 | Adams et al. | |
| 2004/0197152 | A1 | 10/2004 | Beard et al. | |
| 2005/0194782 | A1 | 9/2005 | Duggan | |
| 2011/0094748 | A1 | 4/2011 | Reddy | |
| 2011/0280668 | A1 * | 11/2011 | Norwood | E21B 19/006 405/224.4 |

* cited by examiner

FIG. 5A
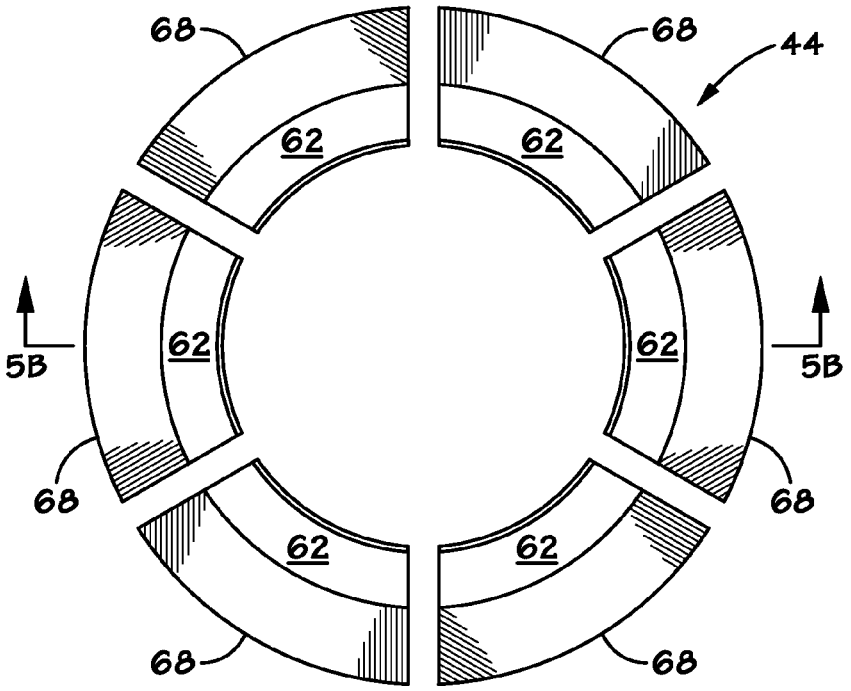
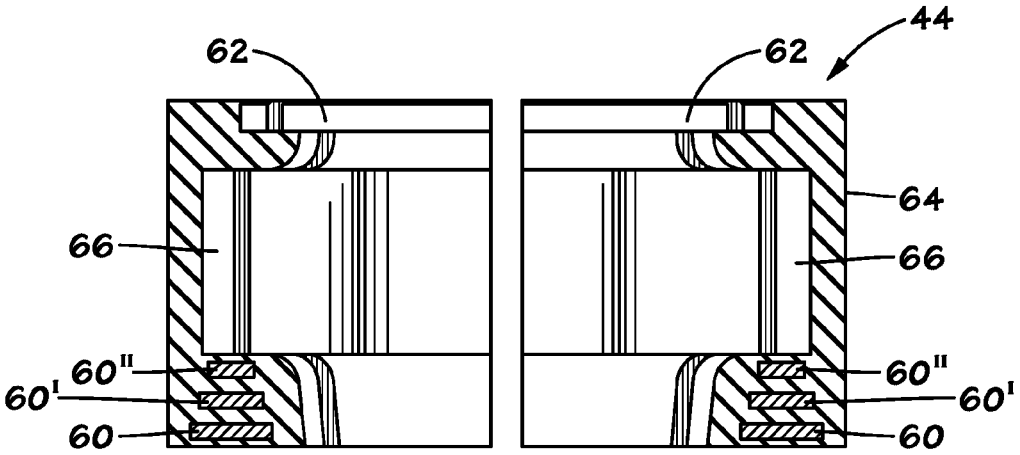
FIG. 5B

FIG. 8A
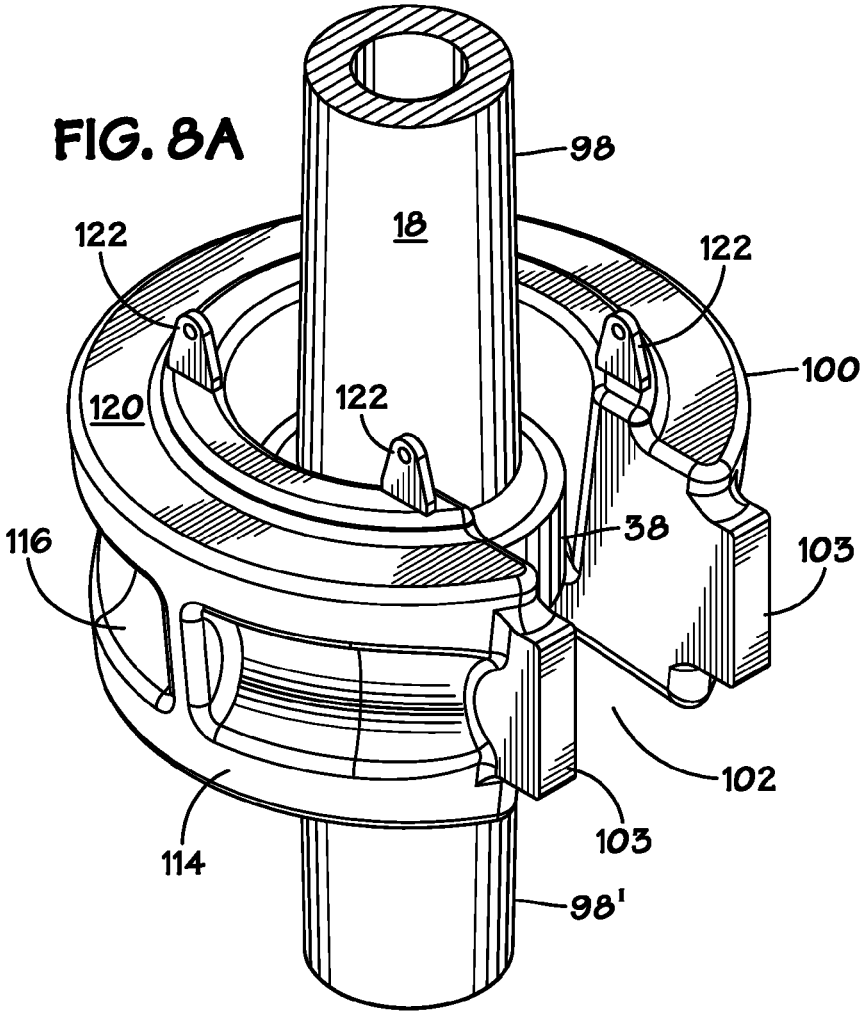
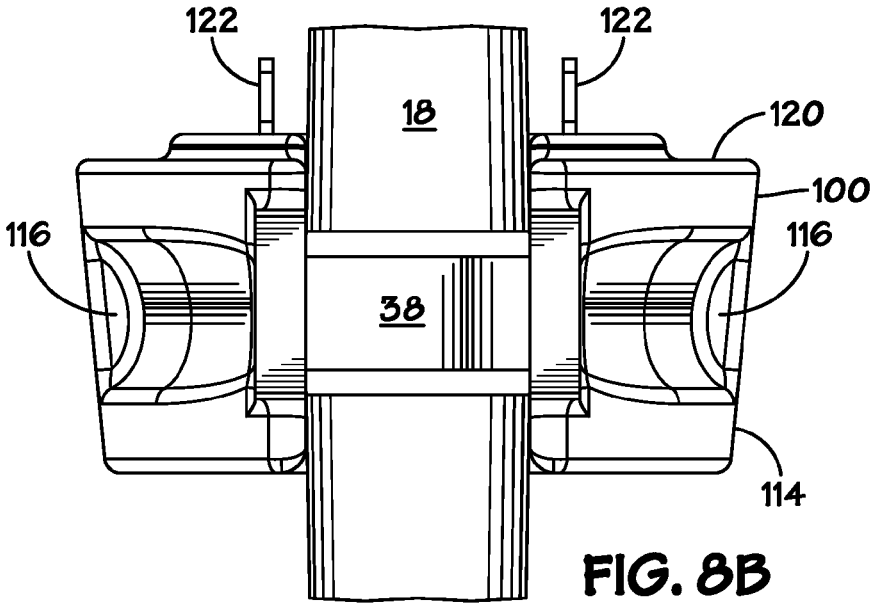
FIG. 8B

FIG. 8C
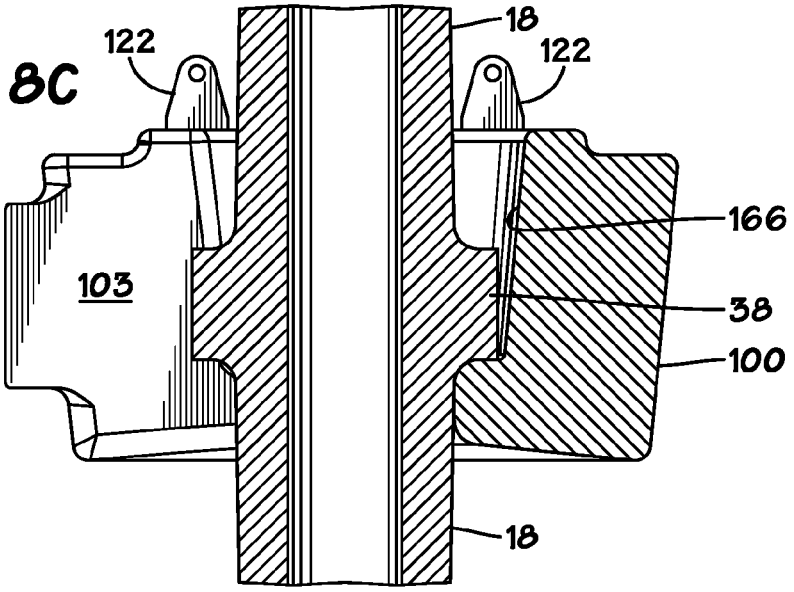
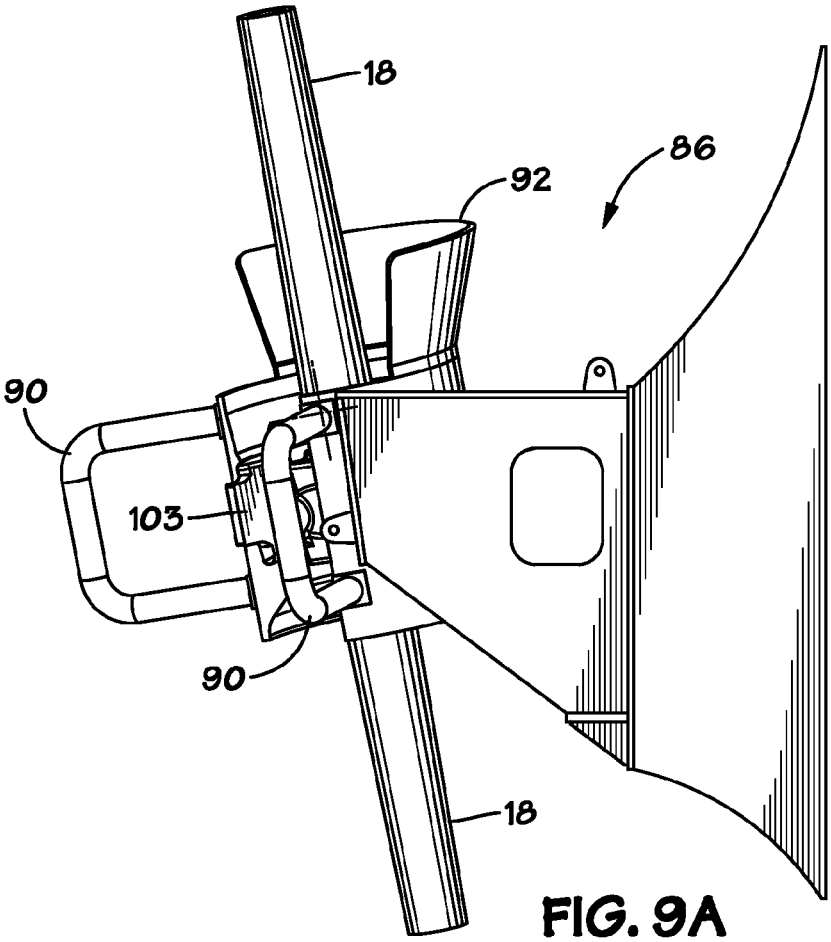
FIG. 9A

METHOD AND APPARATUS FOR ELEVATING THE TAPERED STRESS JOINT OR FLEX JOINT OF AN SCR ABOVE THE WATER

CROSS-REFERENCE TO RELATED APPLICATIONS none

STATEMENT REGARDING FEDERALLY SPONSORED RESEARCH OR DEVELOPMENT

Not Applicable

BACKGROUND OF THE INVENTION

1. Field of the Invention

The present invention generally relates to offshore oil and gas production. More particularly, it relates to steel catenary risers and their connection to floating vessels.

2. Description of the Related Art Including Information Disclosed Under 37 CFR 1.97 and 1.98

A Steel Catenary Riser (SCR) is a steel pipe hung in a catenary configuration from a floating vessel in deep water that is used to transmit fluids such as oil, gas, injection water, etc. to or from pipelines or wellheads on the seafloor. The steel pipe of the SCR forms a catenary between its hang-off point on the floating or rigid platform, and the seabed.

A Floating Production System (FPS) typically consists of a floating unit such as a semi-submersible, FPSO or TLP which may be equipped with drilling and/or production equipment. It may be anchored in place with wire rope and chain, or can be dynamically positioned using rotating thrusters. Production from subsea wells is transported to equipment on the surface deck through production risers designed to accommodate platform motion. An FPS can be used in ultra-deep water.

A semi-submersible is a floating unit, with its deck supported by columns to enable the unit to become almost transparent to waves and provide favorable motion behavior. The unit stays on location using dynamic positioning and/or is anchored by means of catenary mooring lines terminating in piles or anchors in the seafloor.

A DeepDraftSemi® (SBM Offshore, 1255 Enclave Parkway, Houston Tex. 77077) is a semi-submersible unit fitted with oil and gas production facilities in ultra-deep water conditions. The unit is designed to optimize vessel motions to accommodate SCRs.

Floating Production Storage and Offloading system (FPSO) is a floating facility installed above or close to an offshore oil and/or gas field to receive, process, store and export hydrocarbons. It consists of a floater—typically, either new builds or converted tankers, permanently moored on site. The cargo capacity of the vessel is used as buffer storage for the oil produced. The process facilities (topsides) and accommodation are installed on the floater. The mooring configuration may be of the spread mooring type or a single point mooring system, generally a turret.

The high pressure mixture of produced fluids is delivered to the process facilities mounted on the deck of the tanker, where the oil, gas and water are separated. The water is discharged overboard after treatment to eliminate hydrocarbons. The stabilized crude oil is stored in the cargo tanks and subsequently transferred into shuttle tankers either via a buoy or by laying side by side or in tandem to the FPSO. The gas is used for enhancing the liquid production through gas lift, and for energy production onboard the vessel. The remainder is compressed and transported by pipeline to shore or reinjected into the reservoir.

In the case of a spread-moored FPSO/FSO, the tanker or process barge is moored in a fixed heading with anchor lines distributed over the bow and stern of the vessel to anchor points situated on the seabed. The heading is determined by the prevailing sea and weather conditions. The spread-moored FPSO/FSO can only be used in locations where currents, waves and winds are very moderate or normally come from a prevailing direction. With this type of FPSO/FSO, no turret or swivel stack is required, as the vessel does not change heading in relation to the risers connecting the tanker with the wells on the seabed. To offload crude from a spread moored FPSO/FSO, a separate tanker loading facility should be provided as the shuttle tanker cannot safely moor in tandem to the FPSO/FSO due to changing current, wind and wave direction, possible interference with the FPSO/FSO anchor lines, and high risk of collision. Deepwater CALM buoys have been designed as offloading facilities for deepwater spread moored FPSOs In a turret mooring system, the turret system is integrated into or attached to the hull of the tanker, in most cases near the bow, and allows the tanker to weathervane around it and thereby take up the line of least resistance to the combined forces of wind, waves and current. A high-pressure oil and gas swivel stack is mounted onto the mooring system. This swivel stack is the connection between the risers from the subsea flowlines on the seabed to the piping onboard the vessel. It allows the flow of oil, gas and water onto the unit to continue without interruption while the FPSO weathervanes.

For reasons of size and cost, the number of swivels is kept to a minimum, and therefore the flow of oil and gas has to be manifolded in the turret area, particularly when the system produces from a large number of wells.

The turret mooring and high pressure swivel stack are thus the essential components of an FPSO.

Various flexible hang-off arrangements for catenary risers are disclosed in U.S. Pat. Nos. 8,550,171 and 8,689,882 the contents of which are hereby incorporated by reference in their entirety.

A tapered stress joint (TSJ) is a specialized riser joint with a tapered cross section used to distribute bending loads over a controlled length so that the bending stresses are acceptable. Typical locations of TSJs on dry tree production riser systems are at wellhead connection, above and below the keel joint in deep draft vessels. A tapered stress joint configuration for a subsea riser is described in U.S. Pat. No. 6,659,690.

A Remote Operated Vehicle (ROV) is a tethered underwater robot which has been designed to perform unmanned installation tasks or inspection in deep-water environments. They are linked to the installation vessel by an umbilical cable. Electrical power, video and data signals are transferred via the umbilical between the operator and the vehicle. High-power applications will often use hydraulics in addition to electrical cabling. Most ROVs are equipped with at least a video camera and lights. Additional equipment is commonly added to expand the vehicle's capabilities.

BRIEF SUMMARY OF THE INVENTION

A removable riser hang-off connector equipped with a flexible element that, in one embodiment, comprises rubber-encapsulated steel plates, is designed for attachment to a hang-off collar on a steel catenary riser below the tapered stress joint or flex joint. Connection of the removable riser hang-off connector may be made by an ROV.

With the removable riser hang-off connector attached, the tapered stress joint and/or flex joint may be raised out of the water (for inspection, maintenance, repair or replacement) by lifting the upper end of the SCR out of the SCR porch receptacle with a chain jack (or other lifting device) and inserting the removable riser hang-off connector into the porch receptacle. This temporarily supports the SCR in an elevated state with the tapered stress joint or flex joint above the surface of the water.

In an alternative embodiment, the temporary riser hang-off connector may be configured as an adaptor designed for installation directly in the basket receptacle. In such an embodiment, the SCR (equipped with an auxiliary hang-off collar) may be raised out of the hang-off porch receptacle, the adaptor inserted into the porch receptacle (by an ROV or diver), and then the SCR may be re-inserted into the porch receptacle at the elevation of the hang-off collar. In this way, the SCR may be temporarily supported in the basket receptacle with its tapered stress joint and/or flex joint above the surface of the water.

BRIEF DESCRIPTION OF THE SEVERAL VIEWS OF THE DRAWING(S)

FIG. 5A is a top view of a segmented elastomeric element for use in a riser hang-off connector according to a first embodiment of the invention.

FIG. 5B is a cross-sectional view of the elastomeric element shown in FIG. 5A taken along the line indicated in FIG. 5A.

FIG. 8A is a perspective view of a portion of an SCR supported in a riser hang-off connector according to a second embodiment of the invention.

FIG. 8B is a front view of the SCR supported in a riser hang-off connector according to a second embodiment of the invention shown in FIG. 8A.

FIG. 8C is a cross-sectional view of the SCR supported in a riser hang-off connector according to a second embodiment of the invention shown in FIGS. 8A and 8B.

FIG. 9A is a side view of a portion of an SCR supported in the basket receptacle of an SCR porch equipped with a riser hang-off connector according to a second embodiment of the invention, the riser having tapered portions for increased strength above and below the connector.

DETAILED DESCRIPTION OF THE INVENTION

Figure 1A:
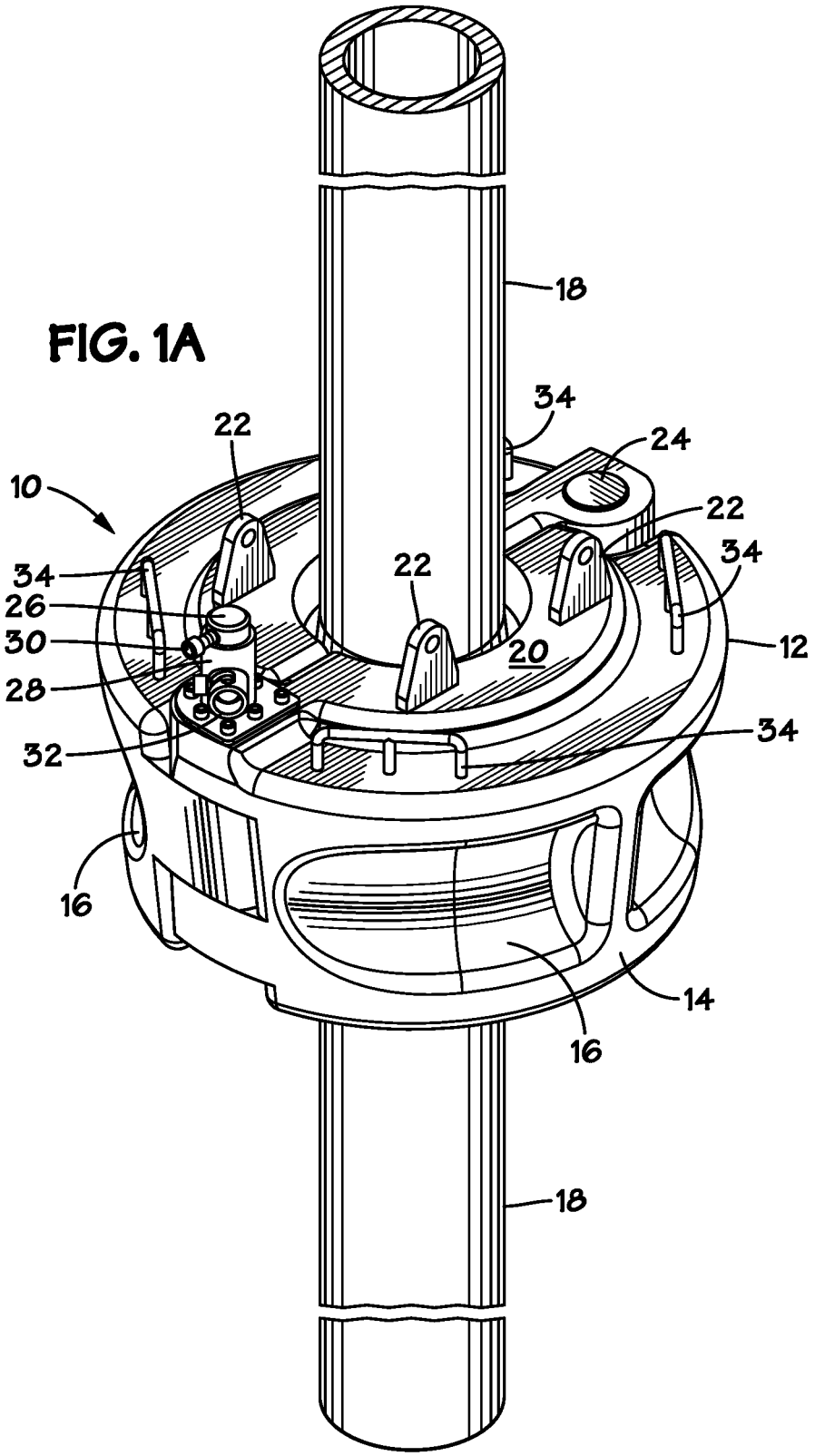
FIG. 1A is a perspective view of a portion of an SCR fitted with a riser hang-off connector according to a first embodiment of the invention shown in the closed position.

This invention concerns a subsea apparatus (connector) for in-situ inspection and/or replacement of flexible and tapered stress joints (TSJ) used in steel catenary riser (SCR) hang-off systems. Recent exploration and production (E&P) in deepwater regions have raised the bar for production temperatures and pressure to upwards of 250° F. and 15,000 psi, respectively. These developments have introduced new challenges for SCR design, fabrication and operations.

Riser hang-off system selection is essential for ensuring safe and reliable production. Therefore, full-scale testing of the flex joints and stress joints for the hang-off system are now standard operating procedure. However, once offshore, there is an increasing need to inspect and replace the hang-off joints—specifically, elastomeric elements at the hang-off location(s). It is now a necessary requirement of production operators to periodically evaluate the integrity of the connection and to inspect and eliminate fatigue damage and/or seal leakage.

In the past, offshore intervention to remove and replace flex and stress joints was carried out using heavy-lift vessels (HLV) and diving operations. The connector of the present invention eliminates the requirements for diving and HLV assistance. The connector in one particular embodiment shown and described herein comprises a forged steel clamping and locking mechanism featuring a hinged connection on one side, and a locking pin on the opposite side. An elastomeric rubber housing is embedded in the connector to provide controlled compliance in all six degrees of freedom with respect to the SCR. An ROV-friendly locking pin and handles are also featured as part of the subsea diver-less installation. In certain other embodiments, the connector is an adaptor placed directly into the riser basket. The SCR pipe welded to the flex joint or stress joint, may be furnished with an integral hang-off collar and radial stoppers (upper and lower) during onshore pipe fabrication to allow for riser load transfer. The hang-off point may be furnished with a tapered joint to ensure appropriate stress distribution during flex joint and stress joints inspection and replacement.

The advantages and benefits of a method and apparatus according to the invention over the systems of the prior art include:

- a connector that may be an integral part of the riser design;
- a connector that eliminates the need for Heavy Lift Vessels and costly weather-dependent marine operations;
- a connector that allows for in-situ periodic monitoring and inspection of hang-off points on both the hull of the FPS and the SCR. Applicable for Floating Production Systems, i.e. spread-moored FPSOs, semi-submersibles and turret-moored systems.

The invention may best be understood by reference to the exemplary embodiments shown in the drawing figures wherein the following figure elements are used:

10 riser hang-off connector
12 hinged body
14 tapered outer surface
16 weight-saving recess
18 steel catenary riser (SCR)
20 upper surface
22 padeye
24 hinge pin
26 locking pin
28 locking pin sleeve
30 limit maching screw
32 locking pin latch
34 ROV-friendly handle
36 upper annular recess
37 lower annular recess
38 hang-off collar
40 landing stopper
42 upper stopper
44 elastomeric element
46 inner recess
48 latch pin
50 machine screw
52 L-shaped slot
54 locking pin receiver bore
56 gap (tolerance)
58 reduced i.d. portion
60 steel plate laminations
62 recess (for element 42)
64 elastomer body
66 recess (for collar)
68 segment
70 tapered stress joint (TSJ)
72 insulating jacket
74 flange connector
76 bushing
77 tapered portion
78 weldment
80 encapsulated flange joint
82 pull head
84 lifting chain
86 SCR porch
88 basket receptacle
90 riser guide arm
92 upper alignment guide
94 flex joint
96 flex joint flange
98 tapered o.d. portion
100 collar adapter
102 opening
103 alignment plates
200 floating production system (FPS)
210 columns
212 pontoons
214 anchor line
216 anchor winch
218 deck structure
220 chain jack
222 gantry
224 chain locker
226 ROV
228 manipulator arm
230 ROV umbilical Referring now to FIG. 1A, riser hang-off connector 10 according to a first embodiment of the invention is shown installed on SCR 18. The illustrated embodiment of riser hang-off connector 10 is a hinged version having two portions which pivot on hinge pin 24 between a closed position (FIG. 1A) and an open position (illustrated in FIG. 1B). Tapered outer surface 14 of hinged body 12 may be configured to seat within the basket receptacle normally used to support the upper end of SCR 18. Upper surface 20 of hinged body 12 may be equipped with one or more lifting padeyes 22 and ROV-friendly handles 34 for installing riser hang-off connector 10 and moving it between the open and closed positions.

In certain embodiments, hinged body 12 may be provided with one or more weight-saving recesses 16 in outer surface 14.

Riser hang-off connector 10 may be secured in the closed position by locking pin 26 which may be configured to slide in locking pin sleeve 28 on upper surface 20. Limit machine screw 30 may be provided in a threaded bore in the side of locking pin 26. Limit machine screw 30 may be configured such that it contacts the upper end of locking pin sleeve 28 when locking pin 26 is in the fully engaged position. Locking pin latch 32 on the side of locking pin sleeve 28 may be configured to secure locking pin 26 in either the locked (inserted) or unlocked (withdrawn) positions. Limit machine screw 30 may also serve as a handle for raising and lowering locking pin 26 with the manipulator arm of an underwater Remotely Operated Vehicle (ROV).

Figure 1B:
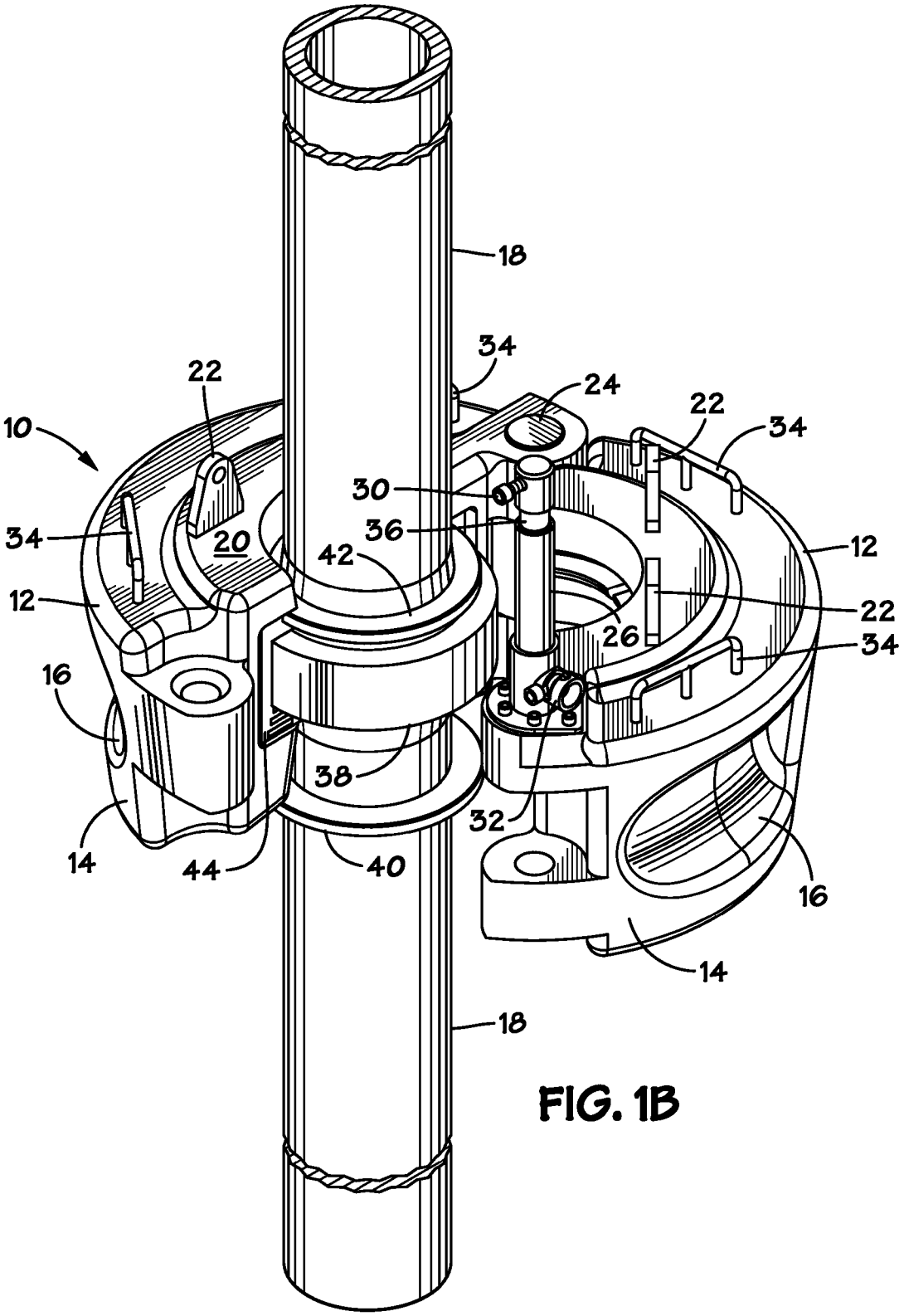
FIG. 1B is a perspective view of a portion of an SCR fitted with the riser hang-off connector illustrated in FIG. 1A shown in the open position.

In FIG. 1B, riser hang-off connector 10 according to a first embodiment is shown in the open position. Locking pin 26 is shown in the raised, unlocked position wherein upper annular recess 36 for engaging latch pin 48 (not shown) may be seen. Also visible in FIG. 1B is segmented elastomeric element 44, hang-off collar 38, landing stopper 40, and upper stopper 42.

Annular hang-off collar 38 may, in certain embodiments, be an integral part of SCR 18. In other embodiments, hang-off collar 38 may be welded or otherwise attached to the outer surface of SCR 18. Hang-off collar 38 is the load-bearing element which supports SCR 18 in riser hang-off connector 10 when riser hang-off connector is seated in the basket receptacle of a riser porch.

Landing stopper 40 and upper stopper 42 are annular flanges attached to or integral with the outer surface of SCR 18. They may be sized and configured to properly align riser hang-off connector 10 so that it may be closed around and properly engage hang-off collar 38.

Figure 2:
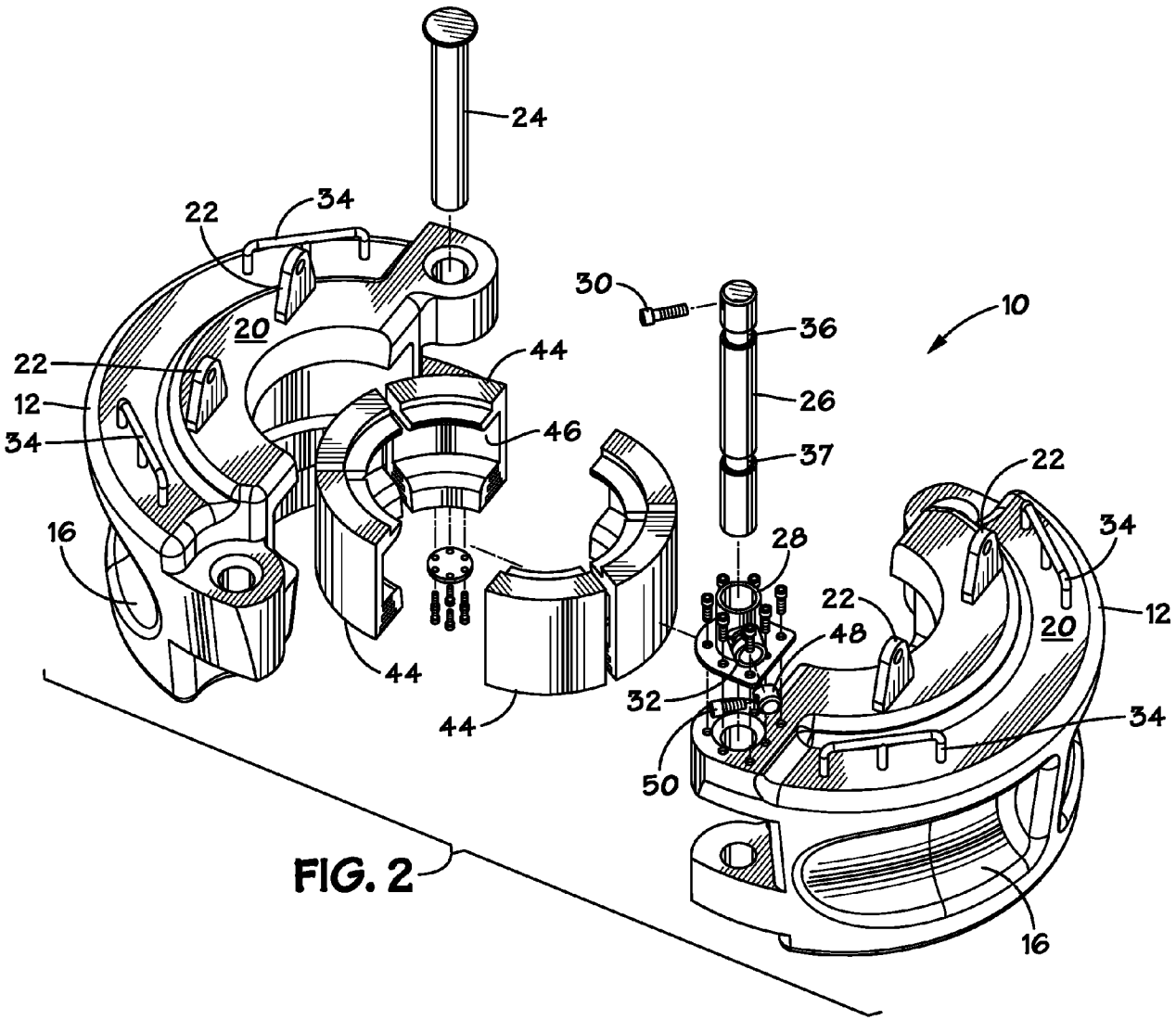
FIG. 2 is an exploded view of a riser hang-off connector according to a first embodiment of the invention.

In the exploded view of FIG. 2, inner recess 46 in segmented elastomeric element 44 is visible. Recess 46 may be sized and spaced to engage the outer, upper and lower surfaces of hang-off collar 38. Also visible in FIG. 2, lower annular recess 37 in the surface of locking pin 26 and latch pin 48 which may slide in locking pin latch 32 to engage either upper annular recess 36 or lower annular recess 37 in latch pin 26 thereby securing latch pin 26 in either the raised (unlatched) or lowered (latched) positions. Machine screw 50 may engage a threaded bore in the side of latch pin 48 and move in L-shaped slot 52 (see FIG. 3) between engaged (inserted) and released (withdrawn) positions. Machine screw 50 may also serve as an actuating handle for latch pin 48 for movement by an ROV manipulator arm.

Figure 3:
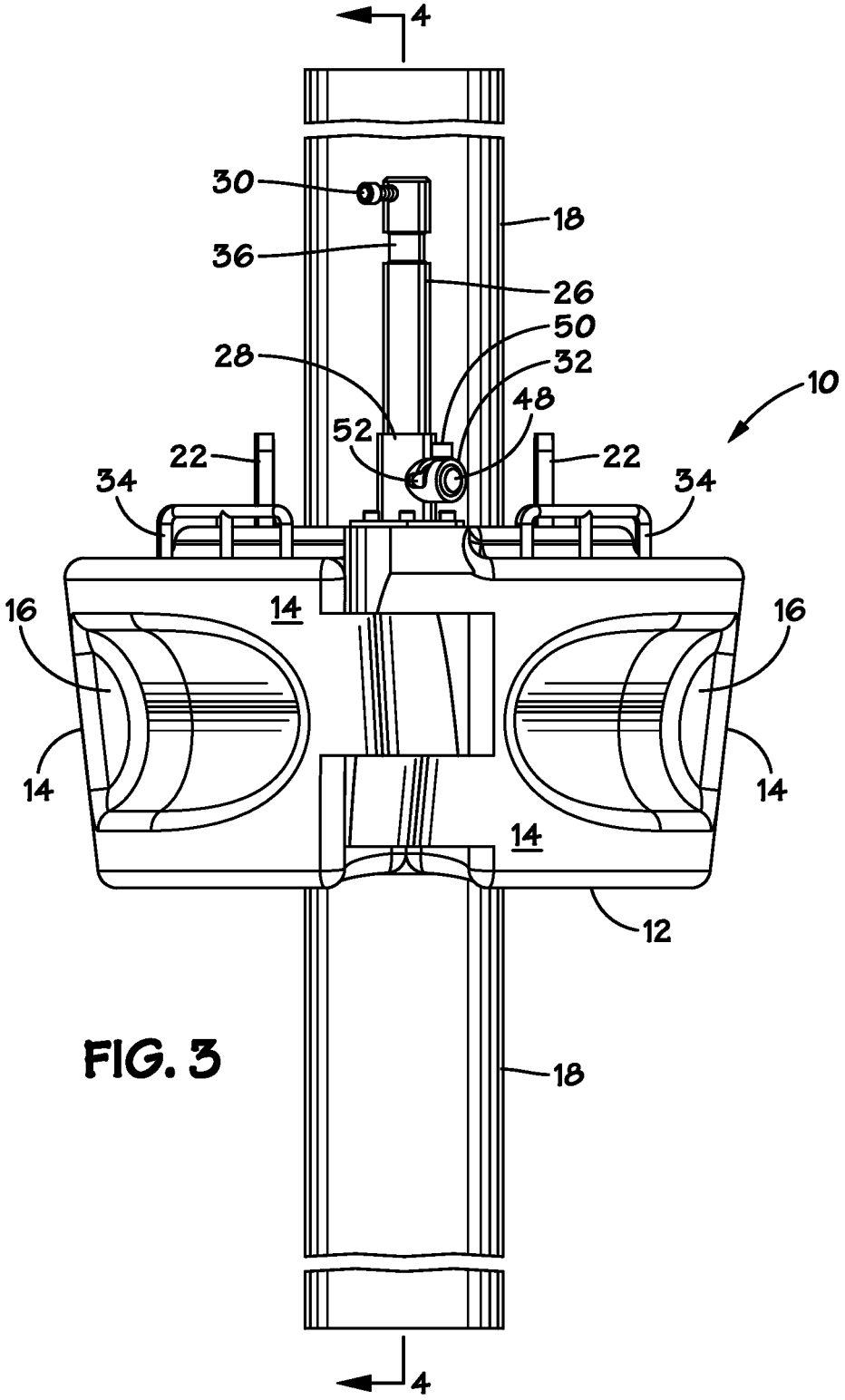
FIG. 3 is a side view of a portion of an SCR fitted with a riser hang-off connector according to a first embodiment of the invention with the locking pin in the unlocked position.

In the side view of FIG. 3, the external end of latch pin 48 may be seen within locking pin latch 32 having L-shaped slot 52 within which machine screw 50 moves.

Figure 4:
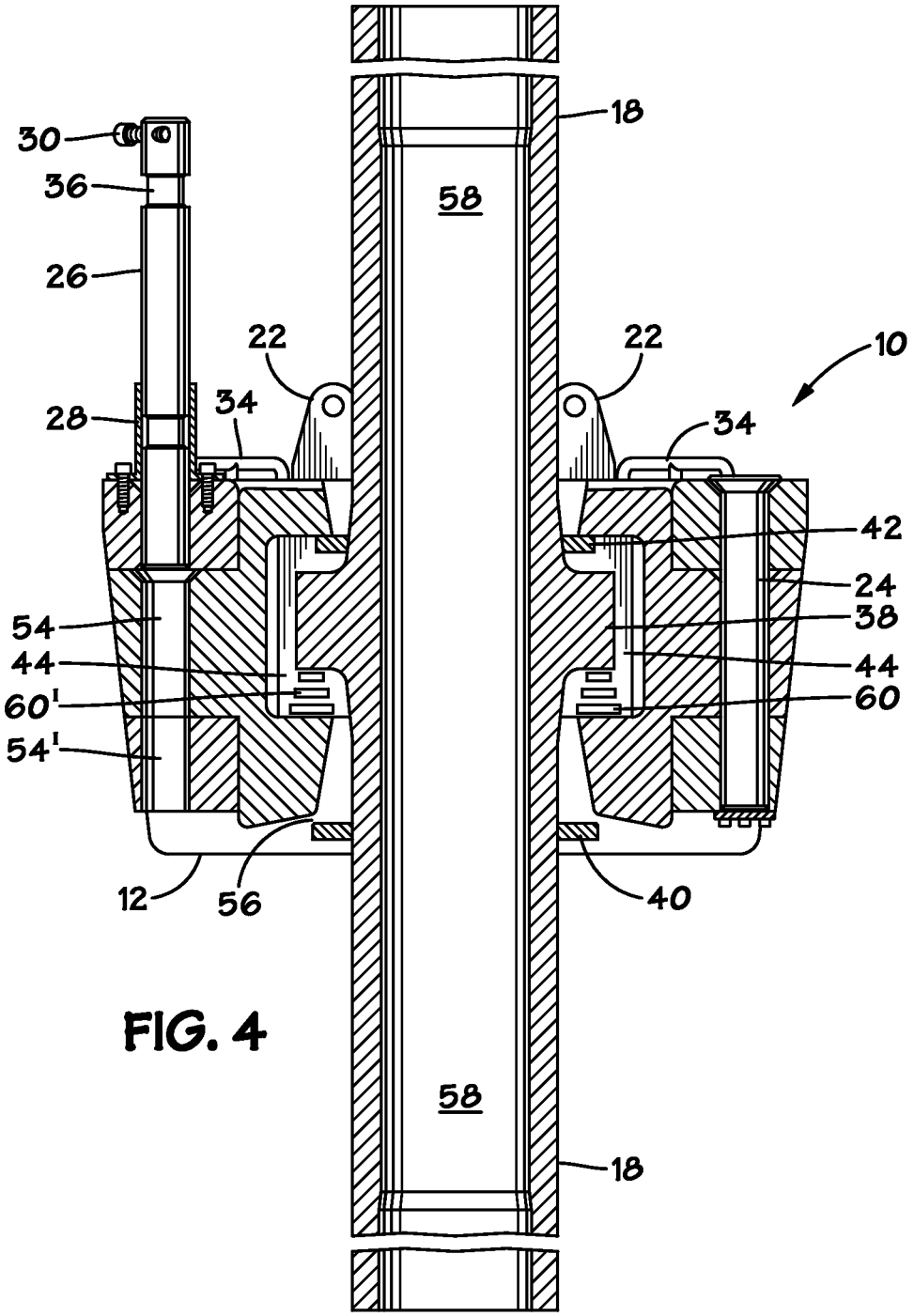
FIG. 4 is a cross-sectional view taken along the line indicated in FIG. 3.

In the cross-sectional view of FIG. 4, locking pin receiver bores 54 and 54' are visible—bore 54 in one hinged portion and bore 54' in the other hinged section of hinged body 12. As illustrated in FIG. 4, the upper end of bore 54 may be provided with a tapered portion of increased internal diameter to help align the two hinged portions as locking pin 26 is inserted.

Also visible in FIG. 4 are steel plate laminations 60 within elastomeric element 44. Steel plate lamination(s) 60 may be provided to increase the stiffness of elastomeric element 44.

As shown in FIG. 4, SCR 18 may have a portion of reduced internal diameter 58 both above and below hang-off collar 38. In portion 58, the walls of SCR 18 are thicker and hence stronger than those portions of SCR 18 having the nominal wall thickness. This may help to distribute the stresses in SCR 18 imposed by supporting the upper end of SCR 18 with hang-off collar 38.

A tolerance gap 56 may be provided between the lower end of hinged body 12 and landing stopper 42 to ensure that landing stopper 40 does not interfere with fully closing hinged body 12 around SCR 18.

FIGS. 5A and 5B show the details of elastomeric element 44 according to the illustrated embodiment of FIGS. 1-4. Annular recess 62 may be provided in the upper surface of elastomer body 64 for accommodating upper stopper 42. Annular recess 66 may be provided for accommodating hang-off collar 38. In the illustrated embodiment, elastomer body 64 is divided into six segments 68 to facilitate installation into (and removal from) riser hang-off connector 10. It will be appreciated by those skilled in the art that elastomer body 64 may be divided into other numbers of segments 68. Also shown in FIG. 5B are steel plate laminations 60, 60', and 60" which may be of graduated size and number to provide the desired degree of stiffness in elastomeric element 44.

Figure 6A:
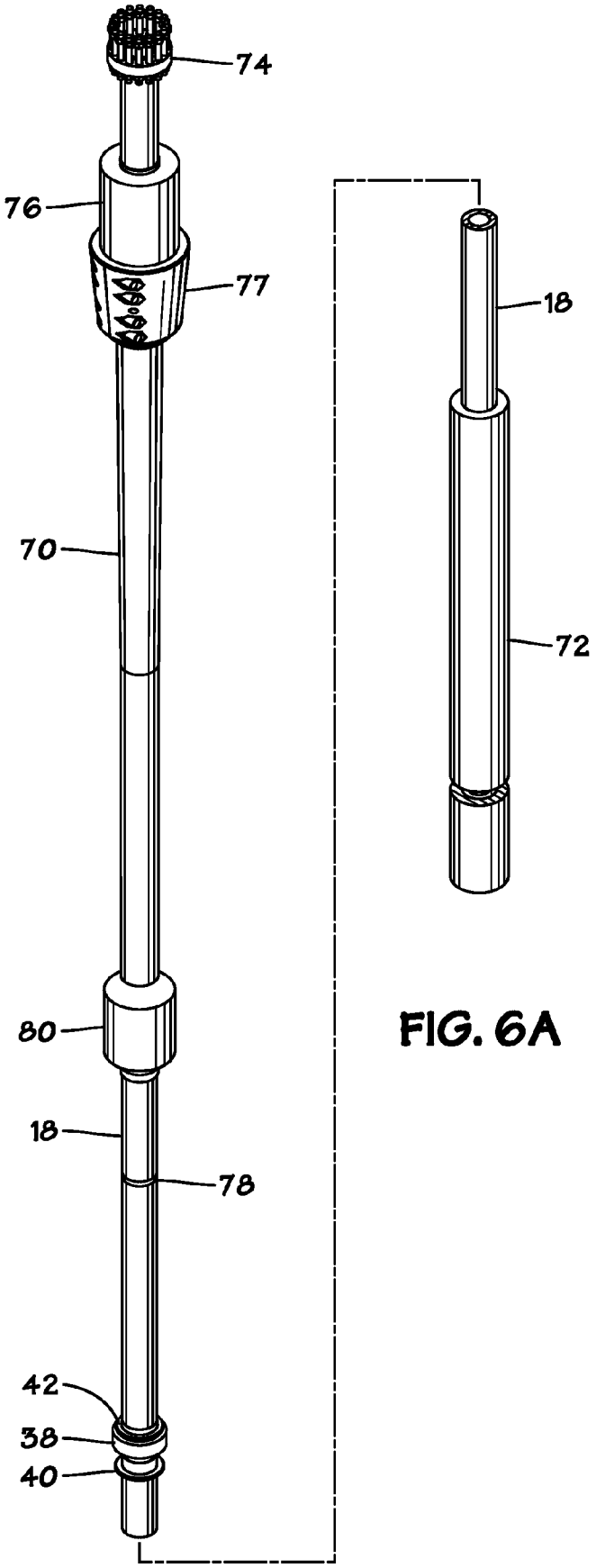
FIG. 6A is a perspective view of the upper portion of an SCR equipped with a tapered stress joint and a hang-off collar, landing stopper and upper stopper according to the invention.
Figure 6B:
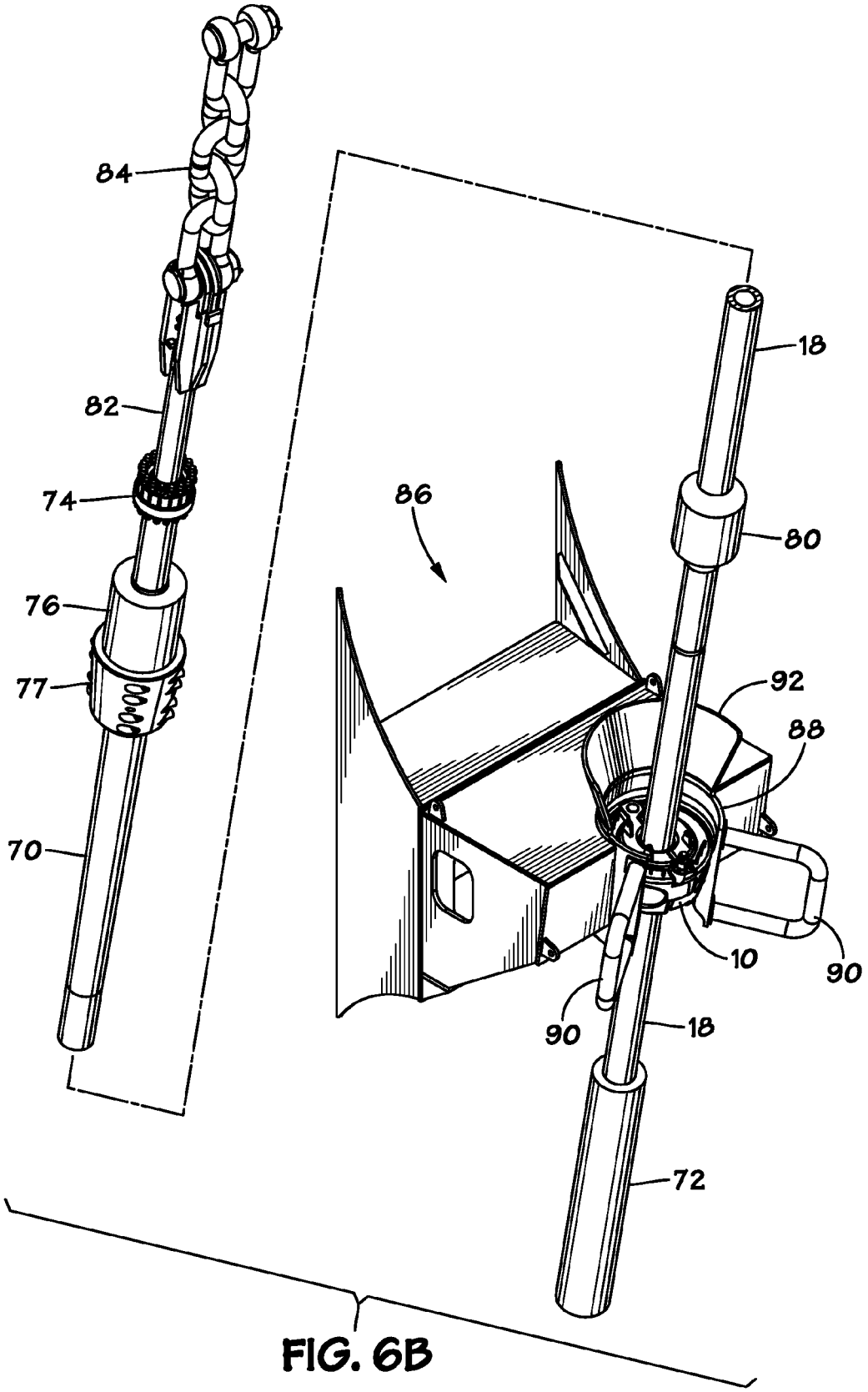
FIG. 6B is a perspective view of the SCR shown in FIG. 6A fitted with a riser hang-off connector according to a first embodiment of the invention supported in the basket receptacle of an SCR porch.

FIGS. 6A and 6B show a steel catenary riser (SCR) 18 equipped with a hang-off collar 38, landing stopper 40, and upper stopper 42 according to the invention. SCR 18 is conventionally equipped with tapered stress joint (TSJ) 70, flange connector 74, bushing 76 having tapered portion 77 (for engaging the basket receptacle of a riser porch), encapsulated flange joint 80, and an insulation jacket 72 on a lower portion thereof. The portion of SCR 18 having hang-off collar 38, landing stopper 40 and upper stopper 42 may be attached to the upper, conventional portions of SCR 18 at weldment 78 prior to the installation of SCR 18.

FIG. 6B shows the upper portion of SCR 18 secured in an elevated state with riser hang-off connector 10 supported in basket receptacle 88 on SCR porch 86. Lifting chain 84 is connected (via a shackle) to pull head 82 the lower end of which may be bolted to flange connector 74 on SCR 18. As described more fully herein below, lifting means connected to lifting chain 84 may be used to lift bushing 76 up and out of basket receptacle 88 and to lower and insert riser hang-off connector 10 in basket receptacle 88 on SCR porch 86. As is conventional, riser guide arms 90 and upper alignment guide 92 may be provided to assist in properly aligning SCR 18 and riser hang-off connector 10 as they are lowered (by means of lifting chain 84) into their seated position in basket receptacle 88.

Figure 7A:
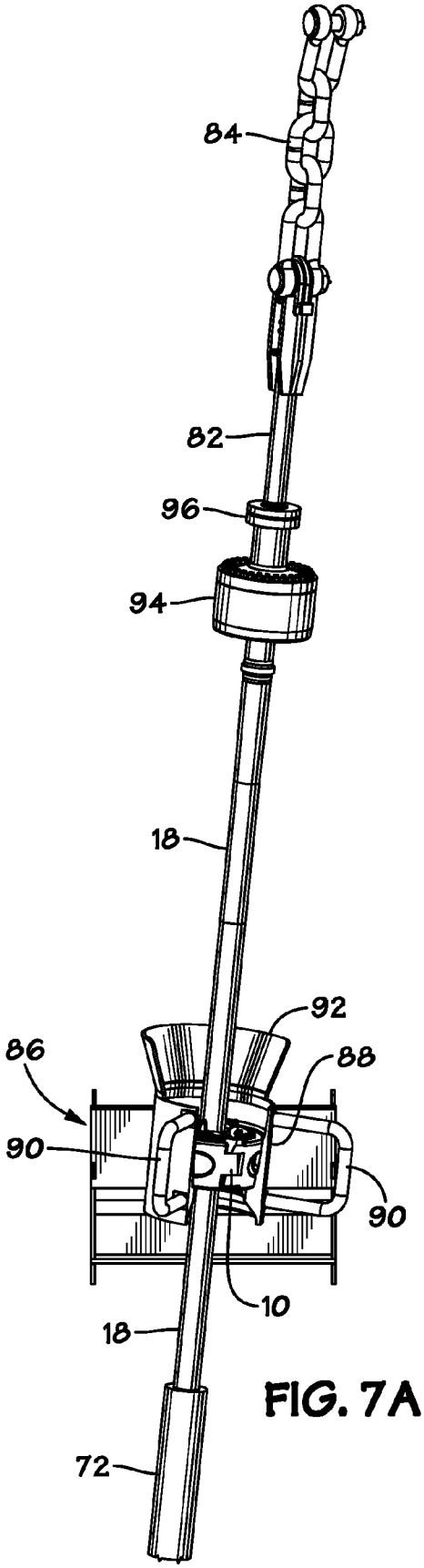
FIG. 7A is a front view of an upper portion of an SCR equipped with a flex joint, the SCR being held in a raised position by means of a riser hang-off connector according to a first embodiment of the invention.
Figure 7B:
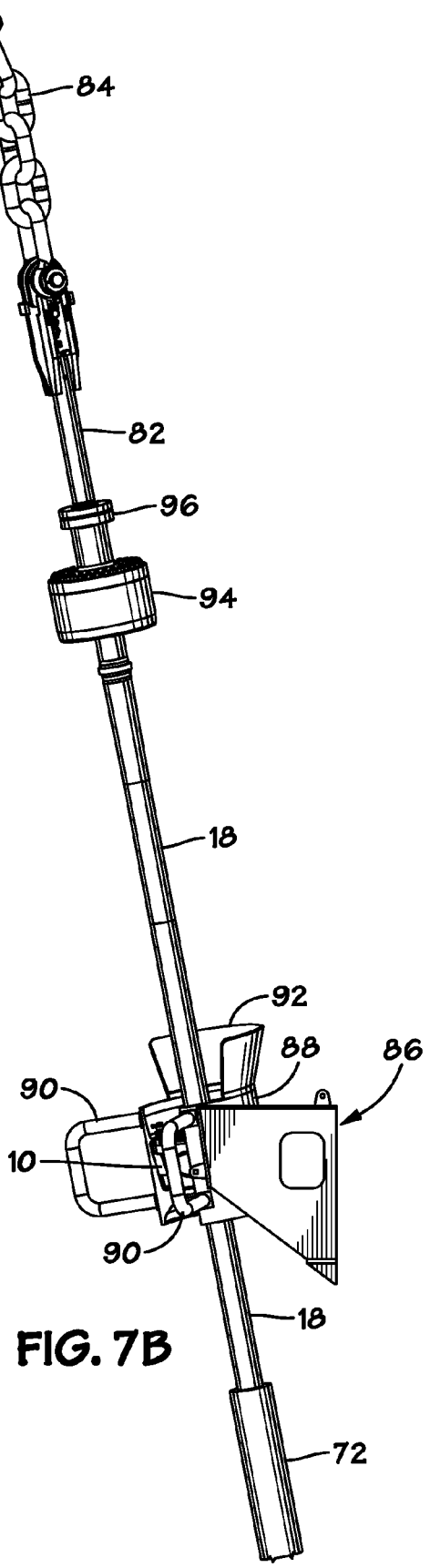
FIG. 7B is a side view of the SCR equipped with a flex joint shown in FIG. 7A.

FIGS. 7A and 7B show a hang-off collar 10 according to the invention connected to and securing SCR 18 equipped with flex joint 94 (in lieu of a Tapered Stress Joint) in an elevated state for maintenance, repair, and/or replacement. As is conventional, the outer surface of flex joint 94 may be tapered to seat in basket receptacle 88. Pull head 82 may be attached to flex joint flange 96.

Figure 7C:
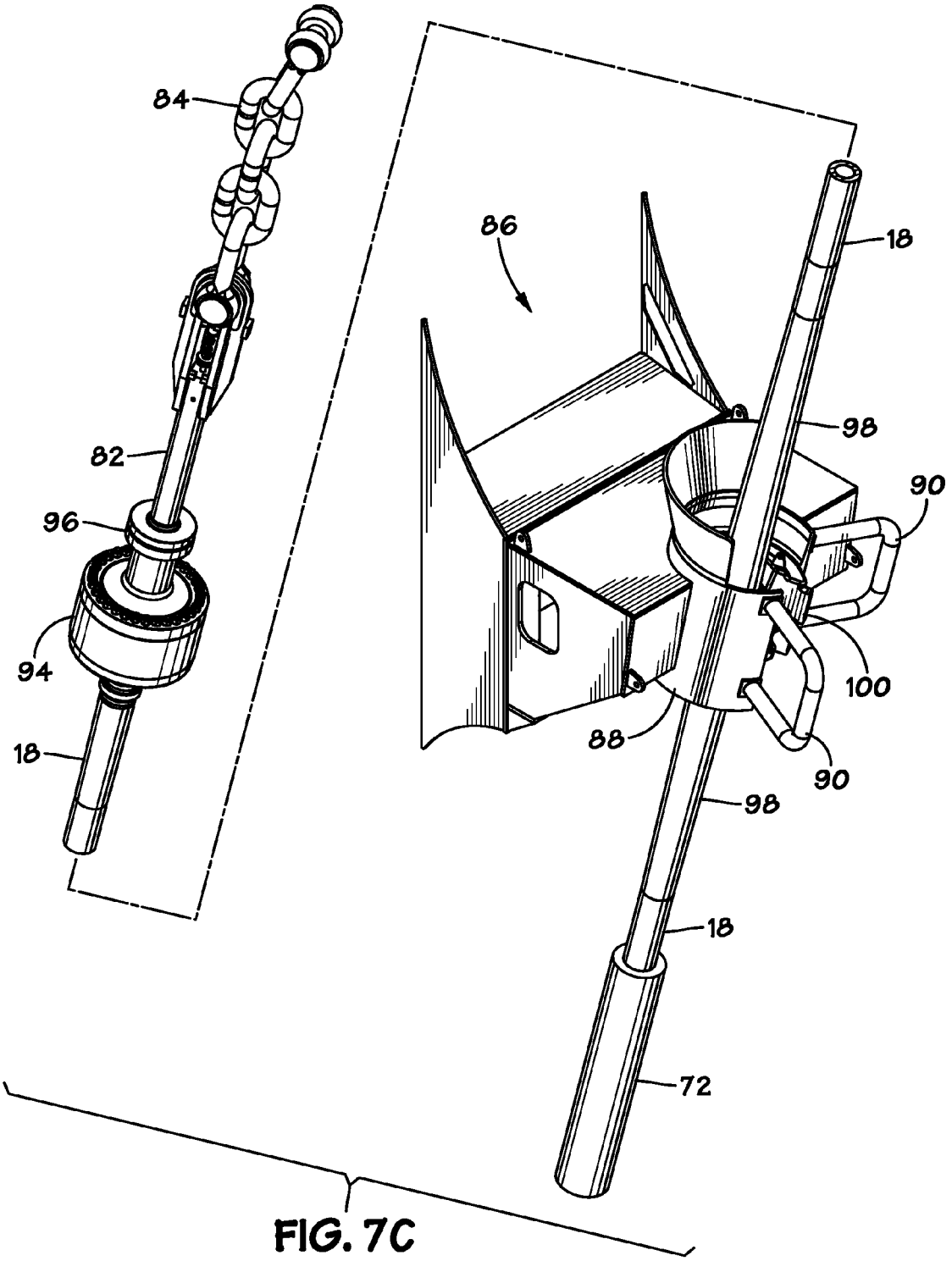
FIG. 7C is a perspective view of an upper portion of an SCR equipped with a flex joint, the SCR being held in a raised position by means of a riser hang-off connector according to a second embodiment of the invention.
Figure 9C:
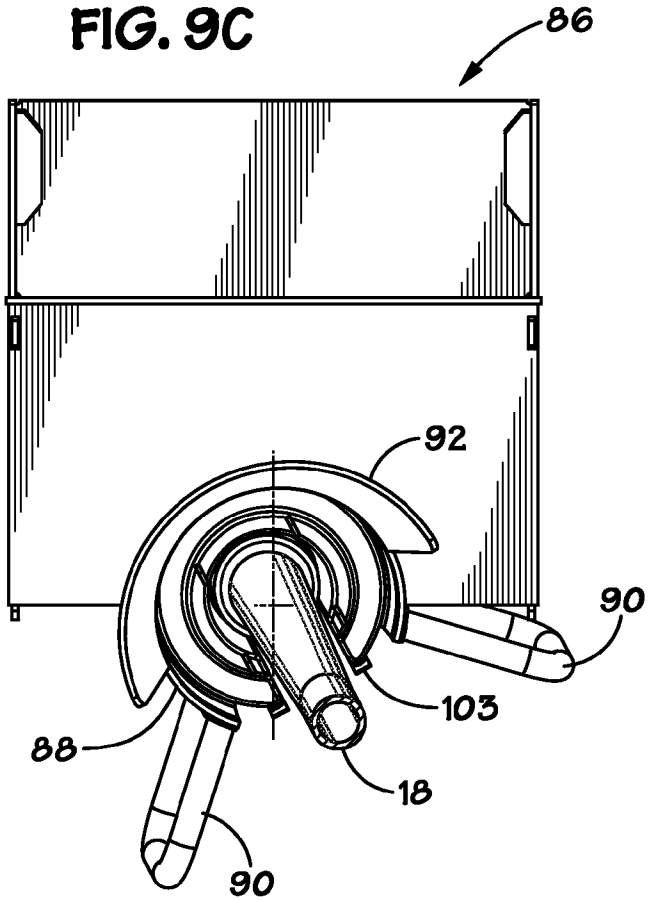
FIG. 9C is a top view of the SCR shown in FIG. 9A.
Figure 9B:
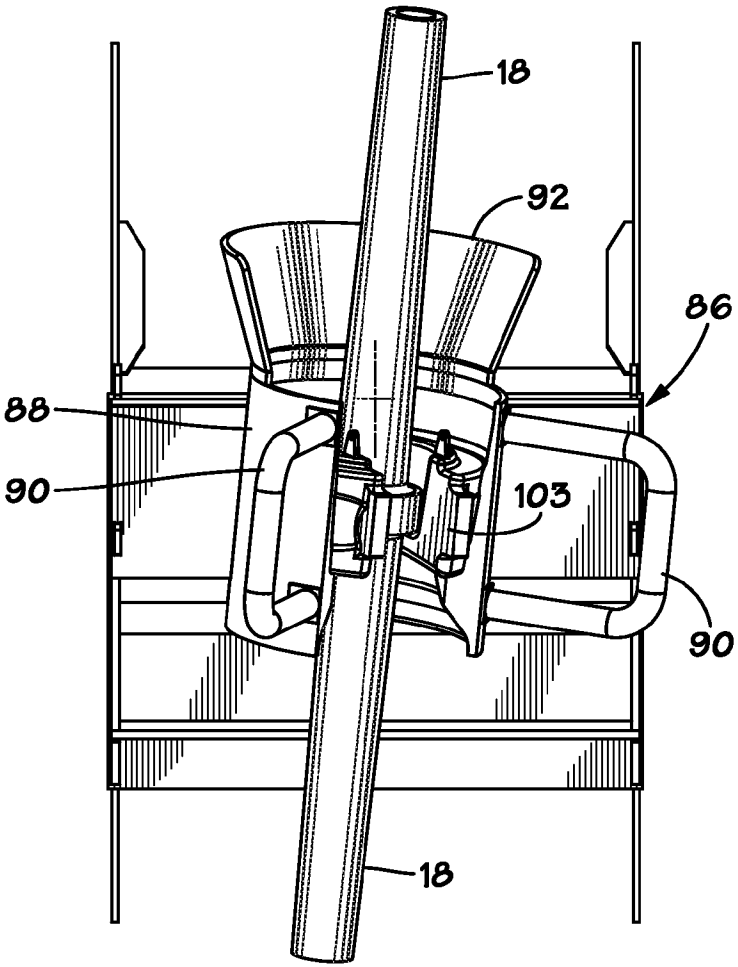
FIG. 9B is a front view of the SCR shown in FIG. 9A.

FIG. 7C illustrates an alternative embodiment of the invention which, in the illustrated example, is applied to an SCR 18 equipped with a flex joint 94. In this embodiment, collar adapter 100 is pre-positioned in basket receptacle 88 subsequent to flex joint 94 being lifted up and out of basket receptacle 88 with pull head 82 and lifting chain 84. As described more fully below, collar adapter 100 is open on one side thereby permitting SCR 18 to be inserted within collar adapted 100 and then lowered until hang-off-collar 38 (not shown in FIG. 7C) seats on collar adapter 100 thereby securing riser 18 in an elevated position above the surface of the sea in which position flex joint 94 may be inspected, repaired, or replaced.

As shown in FIGS. 7C, 8A, 8B, 8C, 9A, 9B, and 9C, steel catenary riser 18 may be provided with portions of increased outside diameter (o.d.) 98 and 98' immediately above and below hang-off collar 38. Portions of increased o.d. 98 and 98' may provide added strength and resistance to fatigue cracking to SCR 18 to better withstand the stresses imposed by supporting SCR 18 with hang-off collar 38 without decreasing the inside diameter (i.d.) of riser 18. As shown in the illustrated examples, portions of increased o.d. 98 and 98' may have a tapered configuration with portions of maximum o.d. adjacent hang-off collar 38.

Additional details of an exemplary collar adapter 100 are shown in FIGS. 8A, 8B, and 8C. Side opening 102 may be flanked by alignment plates 103 which project radially from the body of collar adapter 100. Alignment plates 103 may help to center SCR 18 in the central axial opening 166 of collar adapter 100. Collar adapter 100 may have tapered outer surface 114 to secure it within a correspondingly tapered central axial opening in basket receptacle 88. In certain embodiments, collar adapter 100 may also be provided with weight-saving recesses 116 and/or padeyes 122 on upper surface 120.

When using collar adapter 100, landing stopper 40 and upper stopper 42 on SCR 18 may be omitted.

Figure 10A:
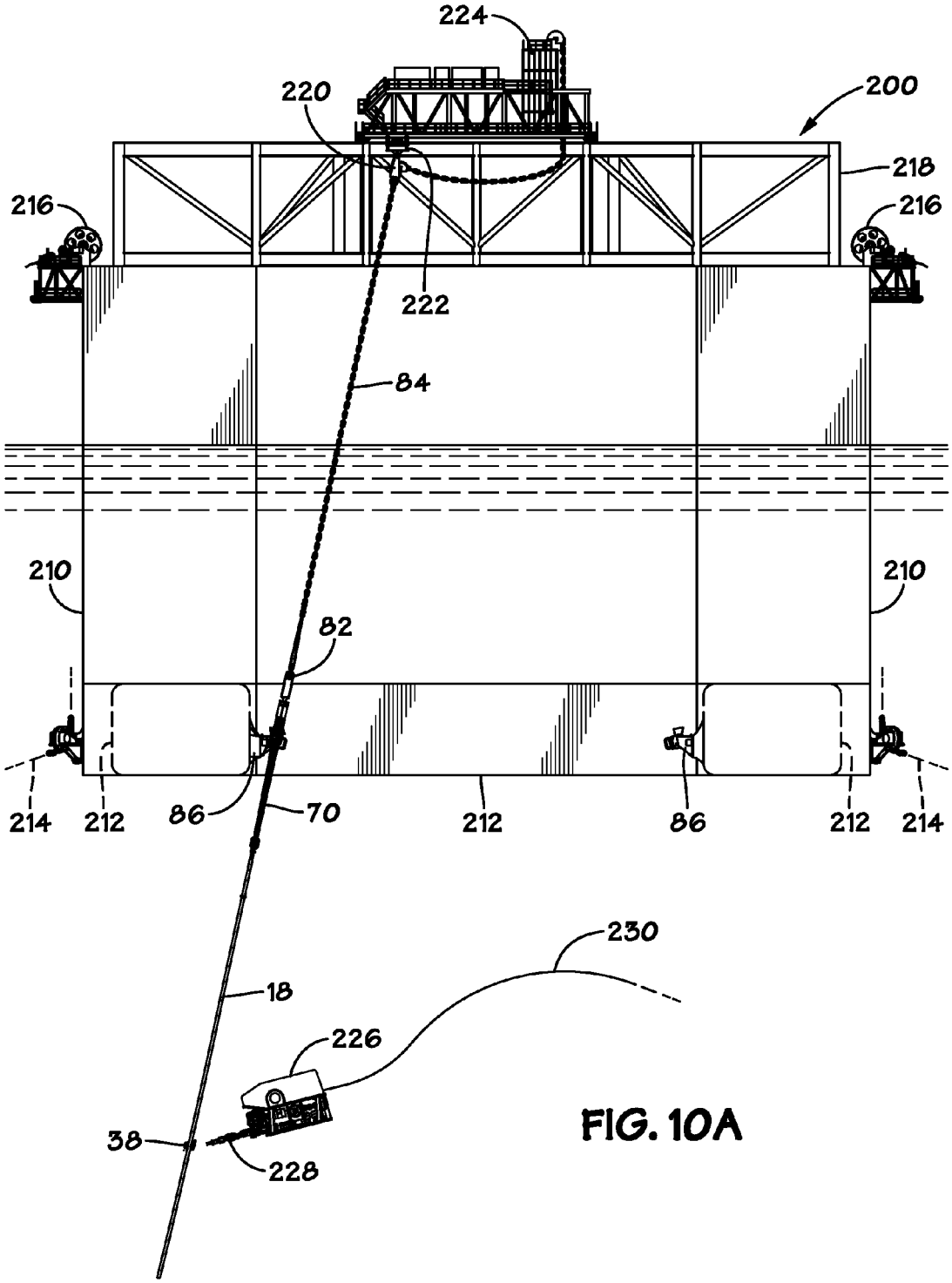
FIG. 10A is a side view of a Floating Production System (FPS) illustrating a first step in a method according to the invention.
Figure 10B:
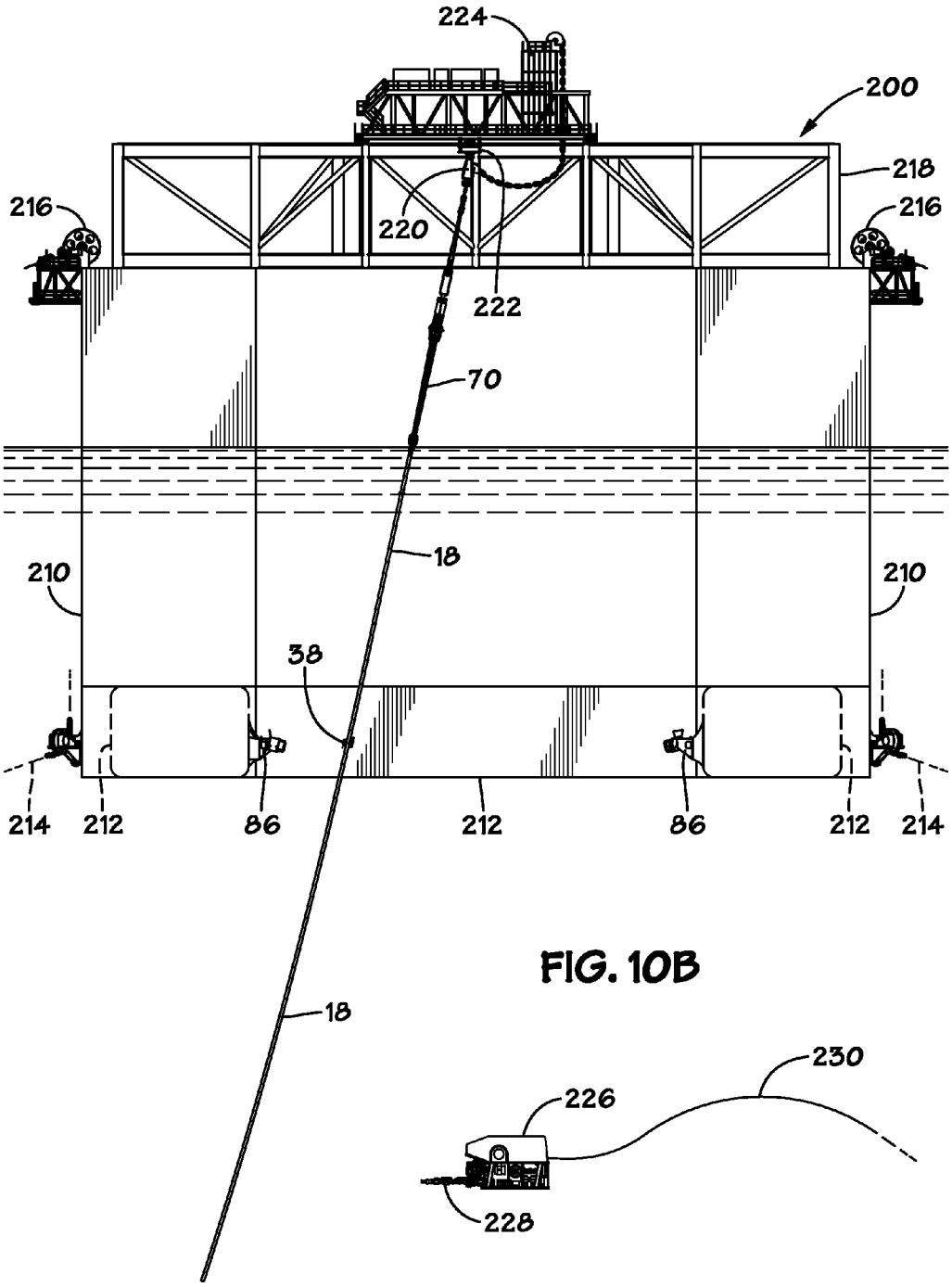
FIG. 10B is a side view of an FPS illustrating a second step in a method according to the invention.
Figure 10C:
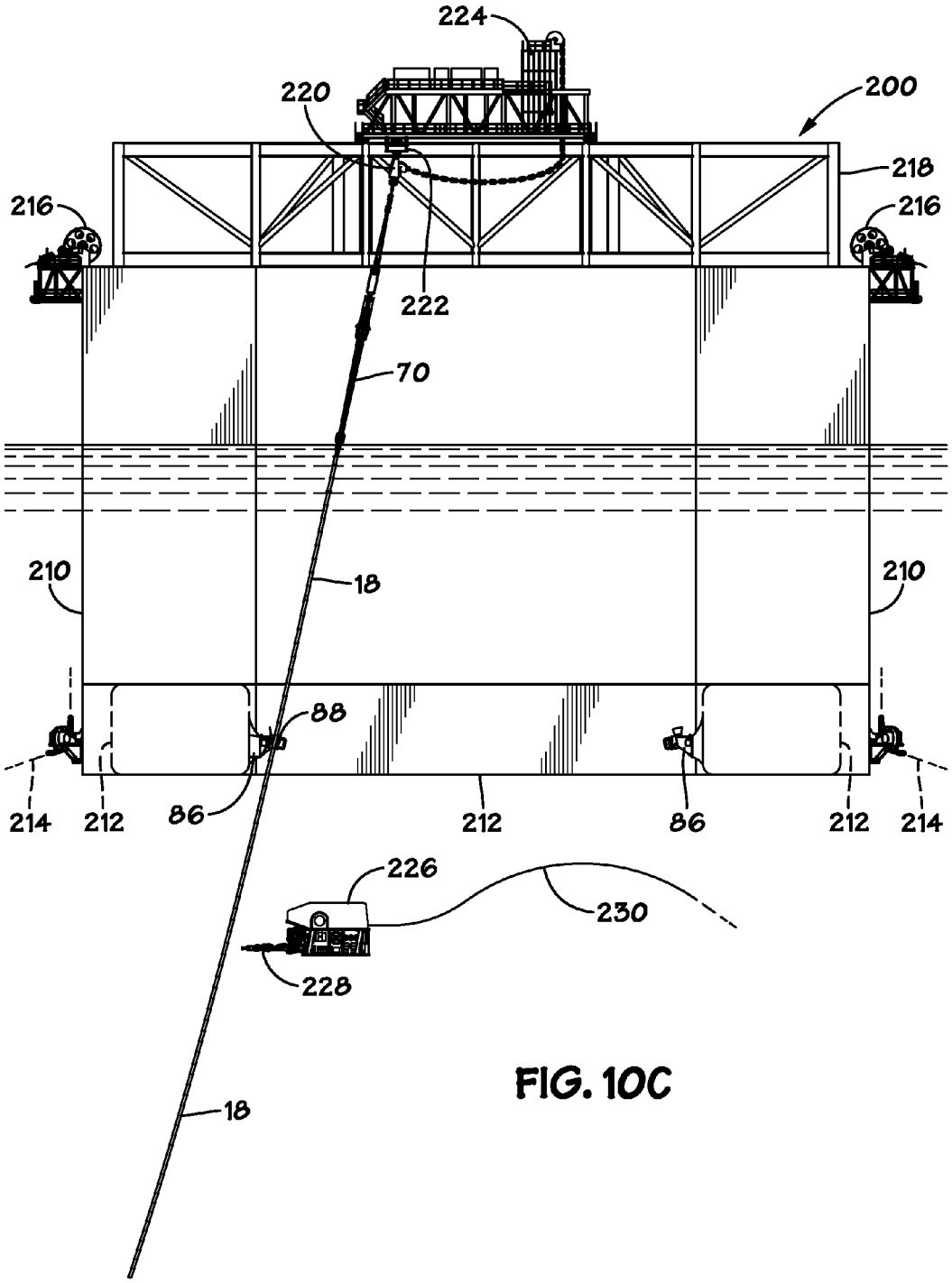
FIG. 10C is a side view of an FPS illustrating a third step in a method according to the invention.

FIGS. 10A, 10B, and 10C sequentially illustrate a method according to the invention for elevating the tapered stress joint 70 of SCR 18 above the waterline so as to permit inspection, repair and/or replacement of TSJ 70. It should be understood that the method applies equally well to elevating a flex joint 94 (not shown) above the waterline so as to permit inspection, repair and/or replacement of the flex joint for SCR's so equipped.

In the illustrated embodiment of FIGS. 10A, 10B, and 10C, the method is shown in use on floating production system (FPS) 200, which, in the illustrated embodiment, is a semi-submersible vessel having surface-piercing columns 210 interconnected with sub-surface pontoons 212. Deck structure 218 is supported above the water on the upper surfaces of columns 210. Station-keeping for FPS 200 is provided by anchor lines 214 which extend from anchor winches 216 to anchors in the seafloor.

In the illustrated embodiment, the means for lifting SCR 18 into the elevated position is chain jack 220 mounted on gantry 222 which provides translational movement. Chain locker 224 may be provided to take in and let out lifting chain 84. Gantry 222 and chain locker 224 are supported by deck structure 218.

In FIG. 10A, steel catenary riser 18 is shown in its nominal position supported by SCR porch 86 but with its upper fluid connections removed and replaced by pull head 82 connected to lifting chain 84 attached to chain jack 220.

FIG. 10A shows remotely operated vehicle (ROV) 226 equipped with manipulator arm 228 and controlled via ROV umbilical 230 preparing to install a riser hang-off connector 10 according to an embodiment of the invention on hang-off collar 38.

Following installation of hang-off connector 10 on hang-off collar 38, SCR 18 may be raised using chain jack 220 by an amount sufficient to clear bushing 76 from basket receptacle 88 on SCR porch 86. SCR 18 may then be extracted from basket receptacle 88 by translational movement of gantry 222. Lifting may then continue until TSJ 70 is sufficiently above the surface of the water to permit inspection, repair and/or replacement. The operation may be monitored to ensure clearance from adjacent risers, flowlines and the like by ROV 226. This state of the system is illustrated in FIG. 10B.

Lifting of SCR 18 may continue until riser hang-off connector 10 on hang-off collar 38 is elevated above basket receptacle 88 on SCR porch 86. SCR 18 may then be moved horizontally by translational movement of chain jack 220 on gantry 222 until SCR 18 is within the central axial opening of basket receptacle 88 at which point SCR 18 may be lowered until hang-off connector 10 is seated in basket receptacle 88 and the upper end of SCR 18 is supported by hang-off collar 38. This state is illustrated in FIG. 10C. As before, this operation may be monitored to ensure clearance from adjacent risers, flowlines and the like by ROV 226.

As will be appreciated by those skilled in the art, in the state illustrated in FIG. 10C, inspection and/or maintenance operations may be performed on TSJ 70 by personnel working e.g. on scaffolding suspended below deck structure 216.

Following inspection, maintenance and/or repair of TSJ 70 (or flex joint 94 for SCRs so-equipped), SCR 18 may be returned to service by reversing the steps of the above-described procedure—i.e., from the state illustrated in FIG. 100, SCR 18 may be lifted using chain jack 220 sufficiently for riser hang-off connector 10 on hang-off collar 38 to clear basket receptacle 88. Translational movement of chain jack 220 by means of gantry 222 may then be used to move SCR 18 out of basket receptacle 88 and into the state illustrated in FIG. 10B. SCR 18 may then be lowered until riser hang-off connector 10 on hang-off collar 38 is below the elevation SCR porch 86 at which point translational movement of chain jack 220 on gantry 222 may axially align SCR 18 with the central axial bore of basket receptacle 88. SCR may then be lowered until bushing 76 is again seated in basket receptacle 88—the state illustrated in FIG. 10A. Lifting chain 84 and pull head 82 may then be removed and the fluid-handling lines reconnected.

A similar procedure may be used for the embodiment illustrated in FIGS. 7C through 9C that utilizes collar adapter 100. It should be appreciated that embodiments using collar adapter 100 do not require the subsea installation of hinged riser hang-off connector 10. Instead, once SCR 18 is in the state illustrated in FIG. 10B, collar adapter 100 may be installed in basket receptacle 88. This installation may be accomplished using divers and/or an ROV. With hang-off collar 38 elevated above basket receptacle 88, SCR 18 may be co-axially aligned with basket receptacle by passing SCR 18 through opening 102 in collar adapter 100. This may be accomplished by translational movement of chain jack 220 on gantry 222. Once alignment is achieved, SCR 18 may be lowered until hang-off collar 38 is seated on or in collar adapter 100. This state is illustrated in FIG. 10C—the state permitting inspection, maintenance and/or repair of TSJ 70 or flex joint 94, as the case may be, above the water. As described above, SCR 18 may be returned to service by reversing the above-described steps.

The invention may be embodied as a subsea riser hang-off connector comprising: a two-piece, generally cylindrical body having an outer surface, an upper surface, a lower surface, a central axial bore and divided axially into a front piece and a rear piece; a hinge connecting the front piece and the rear piece on a first side of the body; a lock releasably connecting the front piece and the rear piece on a second side of the body radially opposite the hinge on the first side of the body; an annular recess within the central, axial bore; and, an elastomeric element within the annular recess, said elastomeric element having a central axial bore.

The outer surface of the generally cylindrical body may be tapered from a first, larger, outside diameter proximate the upper surface to a second, smaller, outside diameter proximate the lower surface. The taper may correspond to an internal taper of a riser basket receptacle on a floating production system.

The elastomeric element may comprise an annular recess in the central axial bore thereof. The elastomeric element may be radially segmented.

The elastomeric element may comprise at least one bonded metal lamination or may comprise a plurality of metal laminations said laminations progressively varying in radial width.

A subsea riser hang-off connector according to the invention may comprise at least one handle on the upper surface. The handle may be sized and configured for manipulation by a subsea remotely operated vehicle.

A subsea riser hang-off connector according to the invention may comprise at least one padeye on the upper surface.

A subsea riser hang-off connector according to the invention may comprise a hinge pin within the hinge connecting the front piece and the rear piece.

A subsea riser hang-off connector according to the invention may incorporate a lock that comprises a locking pin and a locking pin sleeve attached to the upper surface of the generally cylindrical body, the locking pin configured to slide within the locking pin sleeve between a raised position wherein the lock is unlatched to a lowered position wherein the lock is latched. The locking pin may comprise a radial bolt configured to rest on an upper end of the locking pin sleeve when the lock is latched and limit the travel of the locking pin within the locking pin sleeve.

A subsea riser hang-off connector according to the invention may comprise a first annular recess on the locking pin and a locking pin latch on the locking pin sleeve comprising a latch pin sized and configured to engage the first annular recess on the locking pin and thereby secure the locking pin in the latched position. A second annular recess may be provided on the locking pin, said second annular recess sized and configured to be engaged by the latch pin and thereby secure the locking pin in the unlatched position. The locking pin latch may comprise a sleeve projecting radially from the locking pin sleeve, said locking pin latch sleeve having an L-shaped slot in a wall thereof and a radial projection on the latch pin sized and configured to slide within the L-shaped slot and secure the latch pin in a latched condition.

A subsea riser hang-off collar adapter according to the invention may comprise a generally cylindrical body having a tapered outer surface, an upper surface, a lower surface, and a central axial bore, a radial opening in the generally cylindrical body extending from the upper surface to the lower surface and from the central axial bore to the outer surface, and a shoulder within the central axial bore. The taper of the tapered outer surface corresponds to an internal taper of a riser basket receptacle on a floating production system. The subsea riser hang-off collar adapter may further comprise a pair of opposing, radially projecting plates flanking the radial opening in the generally cylindrical body. The radially projecting plates may extend radially beyond the outer surface of the generally cylindrical body.

The invention may be embodied as a steel catenary riser comprising an annular hang-off collar projecting radially from the outer surface of the steel catenary riser proximate an upper end thereof, said hang-off collar sized and configured to fit within the above-described elastomeric element of a subsea riser hang-off connector according to the invention. The annular hang-off collar may be integral with the wall of the steel catenary riser. The steel catenary riser may further comprise an annular, radially projecting landing stopper on the steel catenary riser below the annular hang-off collar, said landing stopper sized and configured to support a subsea riser hang-off connector as described above when said subsea riser hang-off connector is in an open position. The radially projecting landing stopper on the steel catenary riser may be sized and configured to be axially spaced apart from the lower surface of a subsea riser hang-off connector according to the invention when said subsea riser hang-off connector is in a closed position.

A steel catenary riser according to the invention may further comprising an annular, radially projecting upper stopper on the steel catenary riser above the annular hang-off collar, said upper stopper sized and configured to engage the upper end of the annular recess in a subsea riser hang-off connector according to the invention when said subsea riser hang-off connector is in a closed position.

In another embodiment, a steel catenary riser according to the invention may comprise an annular hang-off collar projecting radially from the outer surface of the steel catenary riser proximate an upper end thereof, said hang-off collar sized and configured to fit within a subsea collar adapter according to the invention and bear upon the shoulder within the central axial bore thereof. The steel catenary riser may further comprise a first tapered portion of the steel catenary riser above the annular hang-off collar wherein the outer diameter of the riser progressively decreases from a larger outer diameter proximate the hang-off collar to a smaller, nominal outer diameter of the steel catenary riser at a location distal from the hang-off collar, and a second tapered portion of the steel catenary riser below the annular hang-off collar wherein the outer diameter of the riser progressively decreases from a larger outer diameter proximate the hang-off collar to a smaller, nominal outer diameter of the steel catenary riser at a location distal from the hang-off collar.

The invention may also be embodied as a method for supporting a flex joint or tapered stress joint (TSJ) proximate an upper end of a subsea riser above the surface of the water comprising: attaching a riser hang-off connector to a hang-off collar on the riser; attaching a pull head to the upper end of the riser; attaching a lifting device to the pull head; raising the upper end of the riser with the lifting device to a first position wherein a support bushing or a flex joint on the riser is fully disengaged above a corresponding basket receptacle on a riser porch on a floating production system; moving the riser horizontally to a second position wherein the riser is displaced from the basket receptacle; raising the upper end of the riser with the lifting device to a third position wherein the riser hang-off connector attached to the hang-off collar on the riser is at an elevation higher than the elevation of the basket receptacle; moving the riser horizontally to a fourth position wherein the riser is within the basket receptacle and the riser hang-off connector attached to the hang-off collar on the riser is at an elevation higher than the elevation of the basket receptacle; and, lowering the riser by reverse movement of the lifting device to a fifth position wherein the riser hang-off connector is seated within the basket receptacle. The riser may be a Steel Catenary Riser (SCR). The lifting device may be a chain jack having a chain connected to the pull head. The chain jack may be mounted on a gantry and moving the riser horizontally may comprise moving the gantry. Attaching the riser hang-off connector to a hang-off collar on the riser may be performed by a subsea remotely operated vehicle (ROV). The riser hang-off connector may be a hinged riser hang-off connector according to the invention, as described above.

The method may further comprise performing inspection, maintenance, or replacement of a flex joint or TSJ on the riser while the riser is in the fifth position. The method may comprise providing scaffolding supported below a deck of the floating production system.

Following inspection, maintenance or repair, the riser may be returned to service by: raising the riser from the fifth position to the fourth position; moving the riser horizontally from the fourth position to the third position; lowering the riser to the second position; moving the riser horizontally from the second position to the first position; and, lowering the riser sufficiently to seat the bushing or flex joint in the basket receptacle on the riser porch of the floating production system. The method may further comprise detaching the riser hang-off connector from the hang-off collar on the riser.

The invention may be embodied as a method for supporting a flex joint or tapered stress joint (TSJ) proximate an upper end of a subsea riser above the surface of the water comprising: providing a hang-off collar on the riser; attaching a pull head to the upper end of the riser; attaching a lifting device to the pull head; raising the upper end of the riser with the lifting device to a first position wherein a support bushing or a flex joint on the riser is fully disengaged above a corresponding basket receptacle on a riser porch on a floating production system; moving the riser horizontally to a second position wherein the riser is displaced from the basket receptacle; installing a collar adapter in the basket receptacle; raising the upper end of the riser with the lifting device to a third position wherein the hang-off collar on the riser is at an elevation higher than the elevation of the basket receptacle; moving the riser horizontally to a fourth position wherein the riser is within the basket receptacle and the hang-off collar on the riser is at an elevation higher than the elevation of the basket receptacle; and, lowering the riser by reverse movement of the lifting device to a fifth position wherein the riser hang-off collar is seated in the collar adapter in the basket receptacle. The collar adapter may be a collar adapter according to the above-described collar adapter. Installing the collar adapter in the basket receptacle may be accomplished with at least one diver or with at least one subsea remotely operated vehicle (ROV). The method may further comprise providing a first tapered outside diameter portion on the riser above the hang-off collar and a second tapered outside diameter portion on the riser below the hang-off collar wherein the wall thickness of the riser in the first and second tapered portions may be greater than the nominal wall thickness of the riser.

The riser may be returned to service by: raising the riser from the fifth position to the fourth position; moving the riser horizontally from the fourth position to the third position; removing the collar adapter from the basket receptacle; lowering the riser to the second position; moving the riser horizontally from the second position to the first position; and, lowering the riser sufficiently to seat the bushing or flex joint in the basket receptacle on the riser porch of the floating production system.

The foregoing presents particular embodiments of a system embodying the principles of the invention. Those skilled in the art will be able to devise alternatives and variations which, even if not explicitly disclosed herein, embody those principles and are thus within the scope of the invention. Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A subsea riser hang-off connector comprising:

a two-piece, generally cylindrical body having an outer surface, an upper surface, a lower surface, a central axial bore and divided axially into a front piece and a rear piece;

a hinge connecting the front piece and the rear piece on a first side of the body;

a lock releasably connecting the front piece and the rear piece on a second side of the body radially opposite the hinge on the first side of the body;

an annular recess within the central, axial bore;

an elastomeric element within the annular recess, said elastomeric element having a central axial bore, wherein the lock comprises a locking pin and a locking pin sleeve attached to the upper surface of the generally cylindrical body, the locking pin configured to slide within the locking pin sleeve between a raised position wherein the lock is unlatched to a lowered position wherein the lock is latched.

2. The subsea riser hang-off connector recited in claim 1 wherein the outer surface of the generally cylindrical body is tapered from a first, larger, outside diameter proximate the upper surface to a second, smaller, outside diameter proximate the lower surface.

3. The subsea riser hang-off connector recited in claim 2 wherein the taper corresponds to an internal taper of a riser basket receptacle on a floating production system.

4. The subsea riser hang-off connector recited in claim 1 wherein the elastomeric element comprises an annular recess in the central axial bore thereof.

5. The subsea riser hang-off connector recited in claim 1 wherein the elastomeric element is radially segmented.

6. The subsea riser hang-off connector recited in claim 1 wherein the elastomeric element comprises at least one bonded metal lamination.

7. The subsea riser hang-off connector recited in claim 6 wherein the elastomeric element comprises a plurality of metal laminations said laminations progressively varying in radial width.

8. The subsea riser hang-off connector recited in claim 1 further comprising at least one handle on the upper surface.

9. The subsea riser hang-off connector recited in claim 8 wherein the at least one handle is sized and configured for manipulation by a subsea remotely operated vehicle.

10. The subsea riser hang-off connector recited in claim 1 further comprising at least one padeye on the upper surface.

11. The subsea riser hang-off connector recited in claim 1 further comprising a hinge pin within the hinge connecting the front piece and the rear piece.

12. The subsea riser hang-off connector recited in claim 1 wherein the locking pin comprises a radial bolt configured to rest on an upper end of the locking pin sleeve when the lock is latched and limit the travel of the locking pin within the locking pin sleeve.

13. The subsea riser hang-off connector recited in claim 1 further comprising a first annular recess on the locking pin and a locking pin latch on the locking pin sleeve comprising a latch pin sized and configured to engage the first annular recess on the locking pin and thereby secure the locking pin in the latched position.

14. The subsea riser hang-off connector recited in claim 13 further comprising a second annular recess on the locking pin, said second annular recess sized and configured to be engaged by the latch pin and thereby secure the locking pin in the unlatched position.

15. The subsea riser hang-off connector recited in claim 13 wherein the locking pin latch comprises a sleeve projecting radially from the locking pin sleeve, said locking pin latch sleeve having an L-shaped slot in a wall thereof and a radial projection on the latch pin sized and configured to slide within the L-shaped slot and secure the latch pin in a latched condition.

16. A steel catenary riser comprising:

an annular hang-off collar projecting radially from the outer surface of the steel catenary riser proximate an upper end thereof, said hang-off collar sized and configured to fit within the elastomeric element of a subsea riser hang-off connector according to claim 1; and an annular, radially projecting landing stopper on the steel catenary riser below the annular hang-off collar, said landing stopper sized and configured to support the subsea riser hang-off connector according to claim 1 when said subsea riser hang-off connector is in an open position.

17. The steel catenary riser recited in claim 16 wherein the annular hang-off collar is integral with the wall of the steel catenary riser.

18. The steel catenary riser recited in claim 16 wherein the radially projecting landing stopper on the steel catenary riser is sized and configured to be axially spaced apart from the lower surface of the subsea riser hang-off connector according to claim 1 when said subsea riser hang-off connector is in a closed position.

19. The steel catenary riser recited in claim 16 further comprising:

an annular, radially projecting upper stopper on the steel catenary riser above the annular hang-off collar, said upper stopper sized and configured to engage an upper end of the annular recess in the subsea riser hang-off connector according to claim 1 when said subsea riser hang-off connector is in a closed position.

20. A method for supporting a flex joint or a tapered stress joint (TSJ) proximate an upper end of a subsea riser above a surface of the water comprising:

attaching a riser hang-off connector to a hang-off collar on the riser that is axially remote from the flex joint or the TSJ;

attaching a pull head to the upper end of the riser;

attaching a lifting device to the pull head;

raising the upper end of the riser with the lifting device to a first position wherein a support bushing associated with the TSJ or the flex joint on the riser is fully disengaged above a corresponding basket receptacle on a riser porch on a floating production system;

moving the riser horizontally to a second position wherein the riser is displaced from the basket receptacle;

raising the upper end of the riser with the lifting device to a third position wherein the riser hang-off connector attached to the hang-off collar on the riser is at an elevation higher than the elevation of the basket receptacle;

moving the riser horizontally to a fourth position wherein the riser is within the basket receptacle and the riser hang-off connector attached to the hang-off collar on the riser is at an elevation higher than the elevation of the basket receptacle; and, lowering the riser by reverse movement of the lifting device to a fifth position wherein the riser hang-off connector is seated within the basket receptacle.

21. The method recited in claim 20 wherein the riser is a Steel Catenary Riser (SCR).

22. The method recited in claim 20 wherein the lifting device is a chain jack having a chain connected to the pull head.

23. The method recited in claim 22 wherein the chain jack is mounted on a gantry and moving the riser horizontally comprises moving the gantry.

24. The method recited in claim 20 wherein attaching a riser hang-off connector to a hang-off collar on the riser is performed by a subsea remotely operated vehicle (ROV).

25. The method recited in claim 20 wherein the riser hang-off connector is a hinged riser hang-off connector according to claim 1.

26. The method recited in claim 20 further comprising performing inspection, maintenance, or replacement of the flex joint or the TSJ on the riser while the riser is in the fifth position.

27. The method recited in claim 26 further comprising providing scaffolding supported below a deck of the floating production system.

28. The method recited in claim 20 further comprising returning the riser to service by:

raising the riser from the fifth position to the fourth position;

moving the riser horizontally from the fourth position to the third position;

lowering the riser to the second position;

moving the riser horizontally from the second position to the first position; and, lowering the riser sufficiently to seat the bushing or the flex joint in the basket receptacle on the riser porch of the floating production system.

29. The method recited in claim 28 further comprising:

detaching the riser hang-off connector from the hang-off collar on the riser.

* * * * *